US006083284A

United States Patent [19]

Clifford et al.

[11] Patent Number: 6,083,284

[45] Date of Patent: Jul. 4, 2000

[54] APPARATUS AND METHOD FOR MONITORING AND CONTROLLING RATE OF BATH TURNOVER

[75] Inventors: Frank Graham Clifford, Stanley, N.C.; William Tsui, Sale-Cheshire, United Kingdom

[73] Assignee: Falmer Investments, Ltd., Tortola, Virgin Islands (Br.)

[21] Appl. No.: 09/086,953

[22] Filed: May 29, 1998

Related U.S. Application Data

[63] Continuation-in-part of application No. 09/000,654, Dec. 30, 1997, abandoned.

[30] Foreign Application Priority Data

Dec. 31, 1996 [GB] United Kingdom ..... 9627105

[51] Int. Cl.[7] ..... D06B 3/10

[52] U.S. Cl. ..... 8/158; 68/184; 68/189

[58] Field of Search ..... 8/158, 159; 68/189, 68/198, 184, 12.19, 181 R, 177, 178

[56] References Cited

U.S. PATENT DOCUMENTS

| | | | |
|---|---|---|---|
| 3,145,555 | 8/1964 | Krantz | 68/189 |
| 3,631,691 | 1/1972 | Karrer et al. | 68/189 |
| 3,760,614 | 9/1973 | Bergholtz | 68/189 |
| 3,916,653 | 11/1975 | West et al. | 68/189 |
| 5,323,629 | 6/1994 | Aurich et al. | 68/189 |
| 5,787,733 | 8/1998 | Volpi | 68/184 |

FOREIGN PATENT DOCUMENTS

| | | | |
|---|---|---|---|
| 2525871 | 12/1976 | Germany | 68/189 |
| 61-41364 | 2/1986 | Japan | 8/158 |
| 1-148869 | 6/1989 | Japan | 8/158 |
| 2 266 750 | 9/1995 | United Kingdom . | |
| 2 281 080 | 10/1996 | United Kingdom . | |

*Primary Examiner*—Frankie L. Stinson

*Attorney, Agent, or Firm*—Armstrong, Westerman, Hattori, McLeland, & Naughton

[57] ABSTRACT

A method and apparatus for treating a load with dyeliquor includes a pump/motor set, a dyeliquor circulating system holding the load and directing all the dyeliquor pumped by the pump to flow through the load, a motor current measurement device to measure current consumed by the electric motor while driving the pump, and a throttle valve adjusted to create a flowrate of the dyeliquor through the dyeliquor circulating system based on the current measured by the motor current measurement device. The flowrate of the dyeliquor increases linearly in proportion with increases in the current consumed by said electric motor while driving said pump. The apparatus also has a low system resistance to fluid flow allowing variations in a load resistance of the load to fluid flow to produce corresponding variations in the current of the electric motor measurable by the motor current measurement device.

21 Claims, 5 Drawing Sheets

APPARATUS AND METHOD FOR MONITORING AND CONTROLLING RATE OF BATH TURNOVER

CROSS REFERENCE TO RELATED APPLICATIONS

This is a Continuation-in-Part application of U.S. patent application Ser. No. 09/000,654, filed Dec. 30, 1997 now abandoned.

BACKGROUND OF THE INVENTION

1. Field of the Invention

The invention relates to a method and apparatus for monitoring and controlling rate of bath turnover and has particular though not exclusive application to apparatus for dyeing yarn packages.

2. Description of the Related Art

In the preparation of yarn for the manufacture of textile products, the yarn may be prepared for dyeing by winding it on to a perforated cylindrical core or dye tube formed as a cylindrical bobbin, such a wound bobbin being referred to as a package. A plurality of packages can be stacked on a plurality of slightly smaller diameter perforated tubes, or possibly cruciform or triangular extrusions, called spindles, mounted vertically on a circular manifold or carrier. The carrier, after loading with dye tubes and packages, can be lowered into a cylindrical vessel known as a kier. The kier is equipped with a pump, a heat exchanger and a reversing valve and may be closed and pressurized. Dyeliquor is then circulated through the packages in both of opposite directions to effect dyeing under pressure and at high temperature.

If liquor were to be made to flow in one direction only, then there would be a tendency for dyeing to be uneven since fibres contacted first by dyeliquor are treated with the most concentrated or least exhausted dyeliquor. If the dye is permitted to "strike" on the inside of the package only, it may take a long time for the concentration level to equalize in the mass of the fibre. It will eventually do this by a process called "migration", by which dye in the more concentrated regions tends to move back into the dyeliquor as the concentration of the dyeliquor decreases and thus moves into fibres which have absorbed lower amounts of dye.

As the temperature is the driving force by which many dyestuffs are absorbed into the molecular structure of fibre, raising the temperature on one-way flow, while accelerating the dyeing process, may also increase initial unevenness. It will also increase the need to migrate to a level basis again later. Thus, while dye concentration can eventually become completely even by reliance on migration, the time required for such equilibrium to be reached is many times greater than the time required for a mere application phase; and, it is clearly advantageous to take steps to reduce the need for migration by providing conditions to encourage the dye to strike as evenly as possible.

Periodic flow reversal is an accepted technique to minimize the unevenness; and, optimum evenness can be obtained by relating both frequency of flow reversal and rate of temperature rise to rate of dyebath turnover. Generally speaking, if the flow is reversed as soon as the entire dyebath has passed through the yarn once, in one direction at constant temperature, and then once in the other direction, the difference in depth of shade across the package wall will be more or less as low as possible in the "strike phase". If, as is usual, the process requires that the temperature be increased, then for maximum uniformity of dye application, the amount of the increase needs to be in relation to bath turnover rather than to time.

The physical characteristics of the yarn and consequently the resistance to flow of the package itself may change as temperature is increased, thus altering its resistance to flow, so that the rate of flow may not be the same in both directions and the expression "liters per minute" may be a less meaningful measure of the actual work done on the yarn than "bath turnovers per minute".

The package characteristics may change also as flow rate is increased, with a tendency for some packages to "blow" on inside out flow. This does not always mean that the package is physically destroyed, but that deformation of the package or separation of fibres may take place in some areas and not in others, resulting in unequal treatment in different places in the package, particularly at the top or bottom of the spindle or at package spaces, thereby resulting in unlevel application.

On outside to in flow, the spaces in the interstices of the yarn can be almost closed by excessive pressure such that flow is virtually stopped. Also, any deviation from a tolerance acceptable to the dyer needs to be instantly brought to his notice so that a malfunction of a mechanical component can be detected and corrected before sub-standard products are produced, instead of, as happens all too frequently, such correction being effected as a result of an inquest after sub-standard products are produced. The sensitivity and speed of response of flow rate control devices are of major importance.

It was once standard practice to set flow rate by means of a throttle valve which was normally in a wide open position; to set reversal times by means of a mechanical timer; and in the same way, to set temperature on a clockwork pen type recording instrument with a circular chart.

To give a simplified example, if the temperature is to be raised from say 90° C. to 180° C. in 30 minutes, or 3° C. per minute, at a bath turnover rate of 3 per minute, the most level application of dyestuff will result from the carefully controlled increase of 1° C. per bath turnover. Different dyestuffs strike in different temperature ranges and different combinations of dyestuffs will add complications to this simple example. For optimum results, different rates of temperature increase may be required in different temperature ranges during the dye application period.

It is not only to maintain an existing standard, but also to establish and fully exploit the potential of the apparatus on the widest range of packages, that the rate of dyebath turnover should be monitored and accurately controlled.

Accurate measurement of flow rate in close coupled circulating systems such as packing dyeing machines is however not easy, partly because of the inevitable turbulence and eddy currents that are invariably present and also because of the variations in temperature that are inherent in the process. Also, the higher the velocity in the circulating system the further do the flow characteristics depart from the ideal laminar condition required for accurate flow measurement, and the more difficult it becomes to measure the work done on the yarn.

The work done by the pump can be determined from the current which the drive motor which drives it consumes, but in the majority of pumps used in dyeing machines, this does not bear a linear relationship to liquor circulation. It is conventional practice to use volute type pumps in which the pump casing is so shaped as to modify the pump curve by converting velocity into pressure at a chosen part of its range, and it is not uncommon for the current curve to rise to a maximum and then to fall off again. If there are two different flow rates at which the same current is consumed it is obviously unsuitable for control purposes.

SUMMARY OF THE INVENTION

It is an object of the present invention to overcome the flowrate control problems in the conventional dyeliquor circulating systems.

It is another object of the present invention to simplify and accurately control the flowrate of fluid in the circulating system, such as for the rate of bath turnover in a dyeliquor circulating system.

It is yet another object of the present invention to obviate the need for conventional flowmeters.

In order to achieve the foregoing and other objects in accordance with the purposes of the present invention as described herein, an apparatus for treating a load with dyeliquor is provided with a pump/motor set, a dyeliquor circulating system holding the load and directing all the dyeliquor pumped by the pump to flow through the load, a motor current measurement device to measure current consumed by the electric motor while driving the pump, and a throttle valve adjusted to create a flowrate of the dyeliquor through the dyeliquor circulating system based on the current measured by the motor current measurement device. The flowrate of the dyeliquor increases linearly in proportion with increases in the current consumed by said electric motor while driving said pump. The apparatus also has a low system resistance allowing variations in a resistance of the load to produce corresponding variations in the current of the electric motor measurable by the motor current measurement device.

A flowrate controller may also be provided to control adjustments of the throttle valve to control dyeliquor flowrate based on the motor current. The pump may include a pump casing with a collector ring having minimum resistance to flow and ample volume to collect an unmodified flow of dyeliquor directly from a pump impeller.

The throttle valve may also be a reverse valve by which flow is throttled rather than bypassed as the throttle/reverse valve is closed to reverse a flow direction of the dyeliquor, wherein the flowrate being controlled is a rate of dyebath turnover. An angular displacement of the throttle/reverse valve may be continuously adjusted in response to the current measured by the motor current measurement device to control the dyebath turnover flowrate.

Objects of the present invention are also achieved with a method for treating a load with dyeliquor including the steps of pumping the dyeliquor, driving the step of pumping with an electric motor, measuring current consumed by the electric motor during said step of driving, directing all the dyeliquor pumped by said step of pumping to flow through the load, and adjusting a flowrate of the dyeliquor based on the current measured by said step of measuring, wherein the flowrate of the dyeliquor increases linearly in proportion with increases in the current consumed by the electric motor during said step of driving. The method also includes the step of providing a system resistance to dyeliquor flow during said step of directing which allows variations in a load resistance of the load to dyeliquor flow to produce corresponding variations in the current of the electric motor measurable by said step of measuring. The step of adjusting may adjust a dyebath turnover flowrate based on the current measured by said step of measuring.

BRIEF DESCRIPTION OF THE DRAWINGS

The present invention and the objects achieved by it will be understood from the description of the preferred embodiment, taken in conjunction with the accompanying drawings of which.

DETAILED DESCRIPTION OF THE PREFERRED EMBODIMENT

Figure 1:
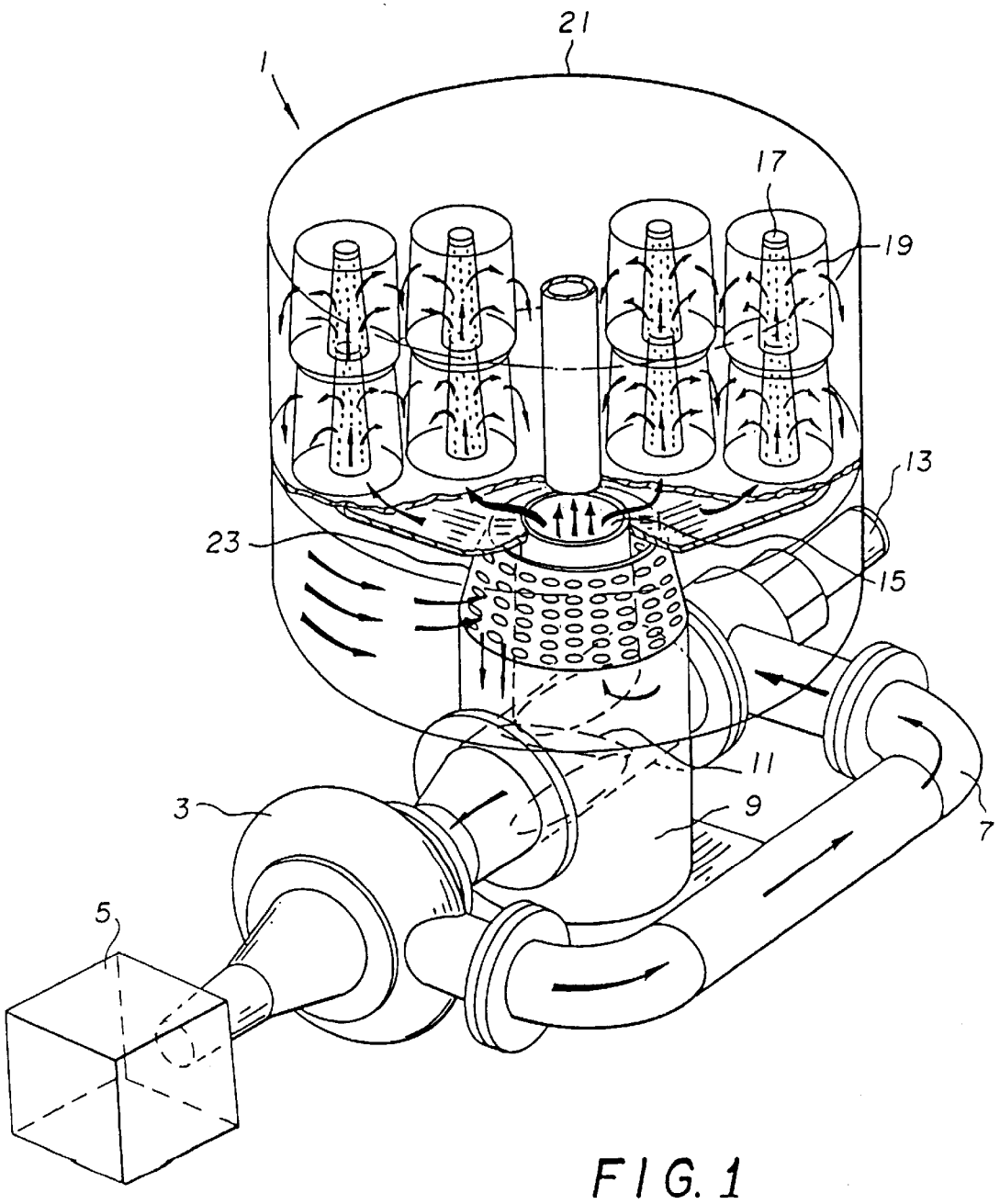
FIG. 1 depicts an apparatus for treating a load with dyeliquor according to a preferred embodiment of the present invention.

Reference will now be made in detail to the present preferred embodiments of the present invention, examples of which are illustrated in the accompanying drawings, wherein like reference numerals refer to like elements throughout.

FIG. 1 depicts an apparatus for treating a load 19 with dyeliquor according to the present invention. The load 19 may include spools of yarn or other materials that are to be treated with a liquid, such as a dyeliquor. The load 19 is placed on holders 17 in a vessel 21 of a dyeliquor circulating system 1.

A pump 3 is driven by an electric motor 5. The pump 3 pumps dyeliquor into the dyeliquor circulating system 1 in the direction shown by the arrows in FIG. 1. The pump 1 is not reversible. The fluid outputted by the pump 1 exits in a unidirectional direction into a pipe 7. Preferably, the pump 3 incorporates a pump casing with a collector ring having minimum resistance to flow and ample volume to collect an unmodified flow of liquor directly from a pump impeller. A collector ring-type centrifugal pump, such as that disclosed in UK Patent GB-2266750 (which is incorporated herein by reference), is particularly suitable as the pump 3.

The dyeliquor enters a housing 9 from the pipe 7 and is directed by a throttle valve 11 (shown in dotted lines in the center of the housing 9 of the dyeliquor circulating system 1). The throttle valve 11 is also a reverse valve in this preferred embodiment, although separate throttle and reverse valves may also be used. When a throttle/reverse valve is used to control dyebath turnover, the flow should be throttled by the reverse valve rather than bypassed as it is closed to reverse the flow direction. The throttle valve is adjusted or reversed by a valve controller 13 (which may include a gear arrangement and motor). Preferably, the angular displacement of the reverse valve can be continuously adjusted for flow control purposes in response to motor current readings.

With the throttle valve adjusted into the angle shown in FIG. 1, the dyeliquor is directed up into a central vertical duct 15. The central vertical duct 15 leads the fluid into each of the holders 17 so that the dyeliquor permeates the load 19 from an inside-out flow direction. The liquor leaving the load 19 returns into a lower portion of the vessel 21, re-enters the housing 9 through a perforated support 23, and back into the pump 3.

To create an out-in flow direction of the liquor into the load 19, the throttle/reverse valve 11 is reversed by the valve controller 13 so that the dyeliquor is directed into portions of the housing 9 outside the central vertical duct 15, out through the perforated support 23, up into the upper portion of the vessel 21, into the load 19, returning to the central vertical duct 15 through the holders 17, and back into the pump 3.

In the preferred embodiment of the present invention, it is also necessary that the entire volume of liquor on which the measured work is being done does in fact pass through the load 19 and that none of it is permitted to bypass back to the pump 3. All of the liquor passing through the pump 3 must always also pass through the load 19 while flow of the liquor is being controlled. Reference may be made to the UK Patent GB-2281080 (which is incorporated herein by reference) for more details on a system which is particularly suitable for use as the dyeliquor circulating system 1.

As indicated in the Background of the Invention section, accurate flow control in conventional close coupled circulating systems operating at a wide range of temperatures has proven to be very difficult. However, the apparatus for dyeliquor treatment according to the present invention achieves an accurate flowrate control by measuring and monitoring the current consumed by the electric motor 5 while driving the pump 3. The throttle valve 11 is adjusted to create a desired fluid flowrate based on the measured values of the current consumed by the electric motor 3. Conventional dyeliquor treatment systems do not rely on the changes in the consumed current of a driving motor to control the flowrate or the rate of bath turnover. Instead, conventional flowrate control typically relies on various types of flowmeters, not by monitoring the driving motor current.

Figure 2:
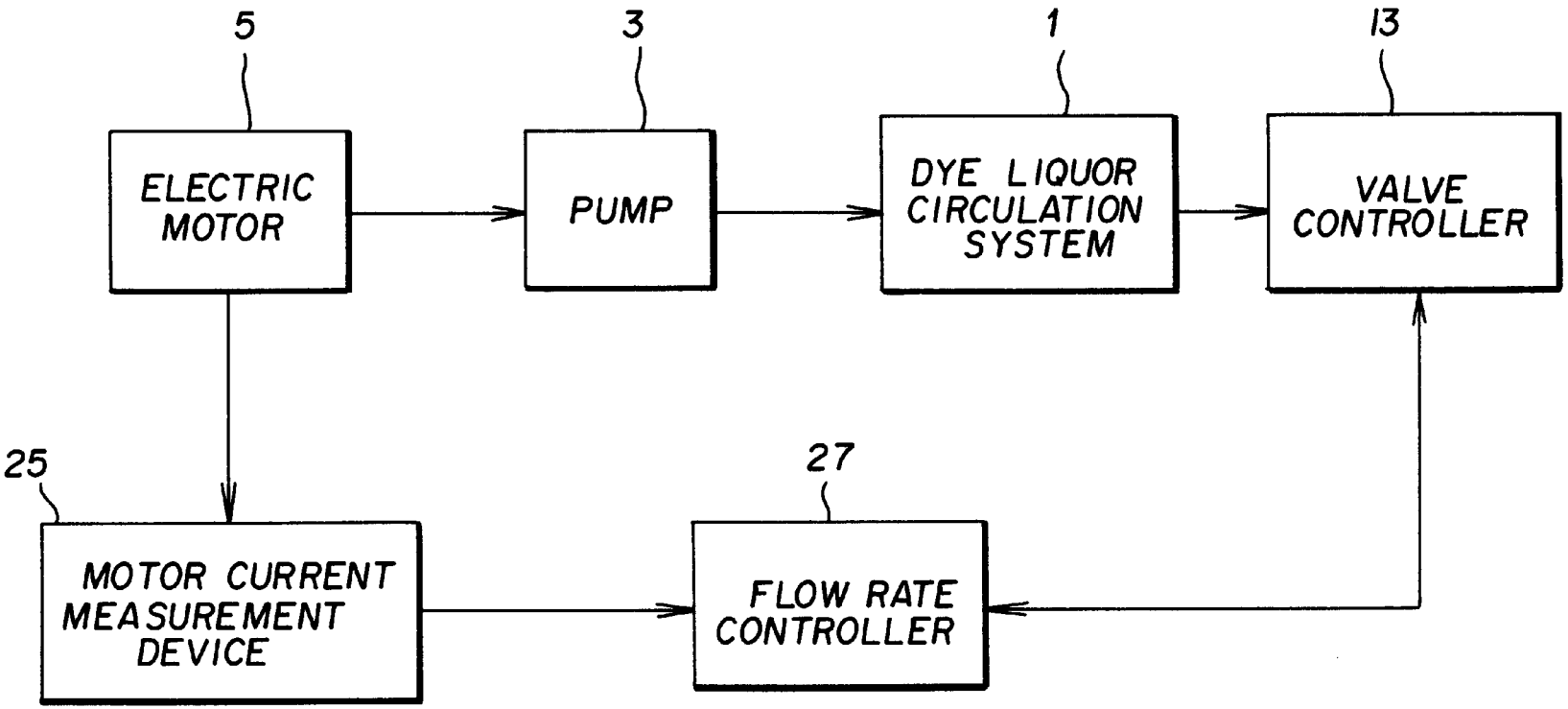
FIG. 2 is a block diagram showing the relationship between various components in a preferred embodiment of the present invention.

As shown in FIG. 2, a motor current measurement device 25 is connected to the electric motor 5 to measure the current used by the electric motor 5 while driving the pump 3. The valve controller 13 is operated to adjust the throttle valve 11 to effect a change in dyeliquor flowrate in the dyeliquor circulating system 1. A flowrate controller 27 may also be employed for monitoring and controlling desired flowrate conditions in various temperatures and dyebath situations. The flowrate controller 27 may be implemented by a computer and/or other electronic components known to those skilled in the art. The flowrate controller 27 processes the current measurements provided by the motor current measurement device 25 in order to automatically control adjustments of the throttle valve 11 via the valve controller 13. One skilled in the art can also design and implement (e.g., using conventional computer technologies) the flowrate controller 27 to accept input from an operator regarding desired bath turnover rates and time periods. The flowrate controller 27 can then sense the level of motor current consumed and automatically control/maintain adjustments of the throttle valve 11 via the valve controller 13 in order to achieve the desired operational parameters set by the operator. Nevertheless, even without the flowrate controller 27, an operator can manually monitor the measured current values and other operating parameters to accurately control the rate of bath turnover.

Figure 3:
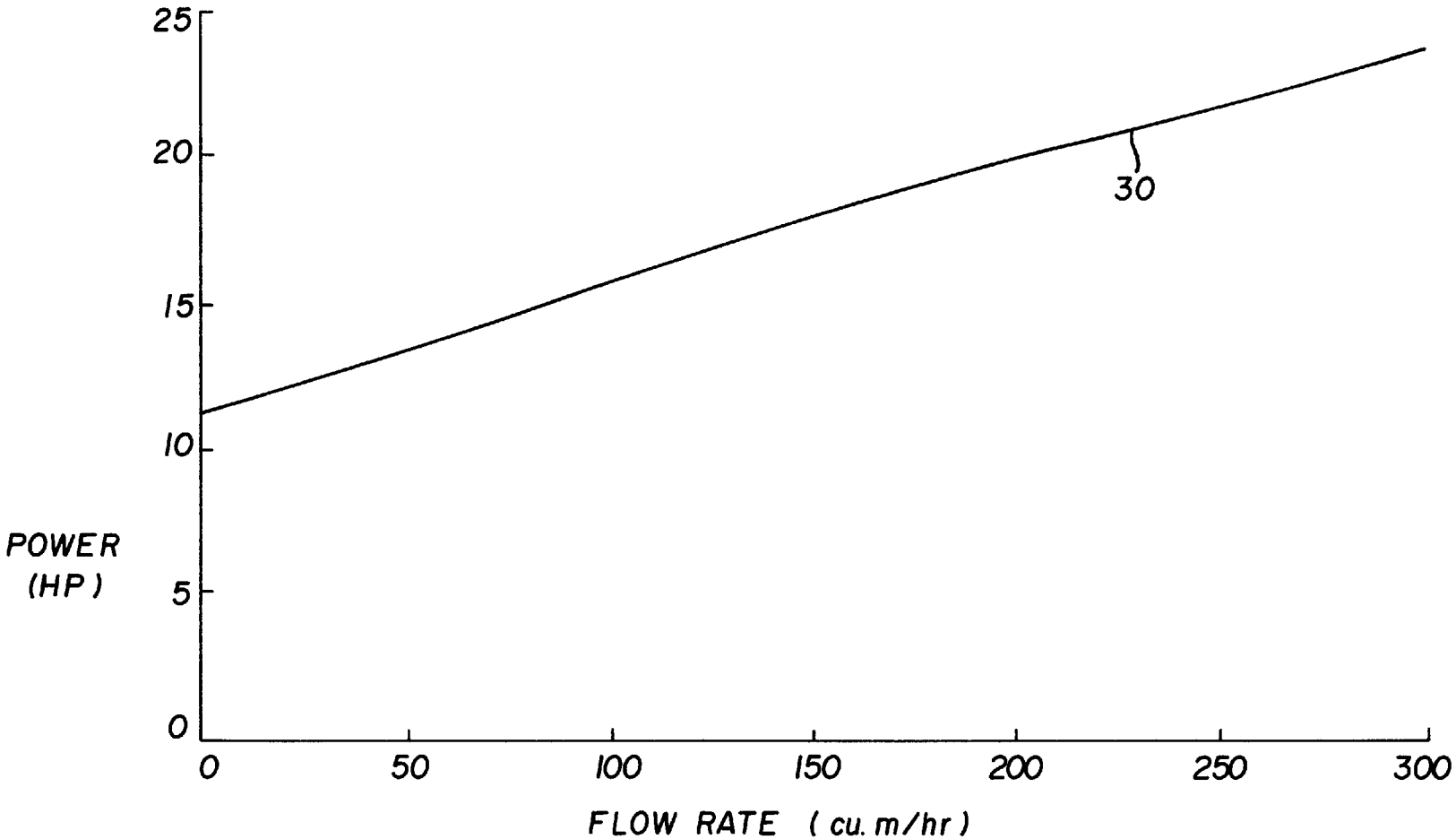
FIG. 3 shows a plot of power versus flowrate for a pump according to a preferred embodiment of the present invention.

According to the preferred embodiment of the present invention, the apparatus for dyeliquor treatment has a dyeliquor flowrate that increases linearly in proportion with increases in the current consumed by the electric motor 5 while driving the pump 3. As shown in FIG. 3, an ideal power curve 30 can provide for an increase in flow of 50 cubic meters per hour to require almost exactly an extra 2 horsepower at any position on the curve. Of course, other ratios of flowrate increases to horsepower consumed may also be utilized. While other ratios may be used, accurate control requires a relatively steep curve for measurability of fine changes. A straight curve is of no use if it is substantially horizontal since there is no inclination to indicate change for control purposes. With the linear proportionally increasing current to flowrate relationship in the present invention, accurate control of the rate of bath turnover based on monitoring and measuring the motor current according to the present invention is made possible.

As mentioned above, the preferred embodiment of the present invention has a substantially linear proportionally increasing power to flowrate relationship. However, the present invention is not limited to absolute linearity nor absolute proportionality in the power to flowrate relationship, as long as both the power consumption and flowrate increase commensurately in an identifiable manner. The power to flowrate relationship need not be represented by a straight, linear, proportionally increasing line. Variations in the proportionality between increases in power consumption to flowrate increases may occur. The power consumption to flowrate relationship may be represented by a curved or an irregularly curved line which does not double back on itself within the selected operating range. What is required in the present invention is that when power consumption increases, so does the flowrate, with an identification of any instances of variation in the proportionality between the respective increases in power consumption and increases in flowrate, and a compensation of any such variations during the adjustment of flowrates in the periods of variation.

The preferred embodiment of the present invention also has a sufficiently low system resistance to dyeliquor flow, wherein variations in the dyeliquor flow resistance of the load itself are able to produce corresponding variations in motor current that are large enough above a constant baseline to be used for monitoring purposes. For example, such a sufficiently low system resistance to fluid flow exists in a dyeliquor treatment apparatus wherein the normal rate of bath turnover can be circulated with the package carrier in the machine (with no actual load installed) by a pump discharge pressure of less than approximately 20 psi. This system resistance condition is suitable for the present invention when treating most types of yarn packages or most of the other easily penetrated textile substrates comprising the majority of the materials being processed today. In contrast, many conventional systems performing a dyeing process for the majority of easily penetrated textile materials have a no-load pump discharge pressure which is unable to fall below 35 psi.

Of course, there are textile materials which present much higher resistance to the flow of dyeliquor, perhaps on the order of 40–50 psi, as in warp beam dyeing. With such higher resistance loads, it would be correspondingly feasible to perform the present invention with much higher system resistance to dyeliquor flow, and even with pumps of the volute type or of any other designs, provided the power curve in the operating range followed the increasing current to flowrate relationship of the present invention and did not double back on itself with increasing flow (in contrast to an unsuitable power curve 50 depicted in FIG. 5 of a conventional system which does double back on itself). One skilled in the art would know how to achieve the appropriate range of low system resistance, and in many cases, it may simply be a matter of using larger diameter pipes and components.

Moreover, as mentioned above, the pump 3 preferably has a minimum resistance to flow, with ample volume to collect the unmodified flow of liquor directly from the pump impeller, so as to ensure that the power curve bears a close relationship to the actual flowrate such that it is ideal for monitoring for control purposes. The preferred embodiment of the present invention may make use of the combination of the collector ring type centrifugal pump disclosed in UK Patent GB 2266750 with the dyeliquor circulating system disclosed in UK Patent GB 2281080 to achieve the above-described low resistance environment with a close relationship between power consumption and flowrate.

In contrast to the present invention, many conventional dyeliquor treatment machines use piping that is too small and include too many components in the circulating system that offer resistance to flow, so that pumps of the volute type are necessary to overcome the resistance. The volute is a specially designed shape of pump casing that permits some of the velocity of the liquor leaving the impeller to be converted into pressure. This invariably takes place at a cost in maximum flowrate, and usually distorts the current curve so that it is no longer a linear representation of the liquor throughput.

Moreover, the high resistance to flow offered by the system itself means that variations of load resistance, which is relatively small in comparison with the system resistance, may be completely undetectable by even the most sensitive measuring instruments, no matter what shape the current curve might be. Many such conventional systems achieve their desired purpose by default, limited by poor system design to virtually one flowrate. It is not uncommon in such conventional systems for the values of motor current, liquor flow, or pump pressure, to be as nearly the same with a load in the machine or with no load in the machine, as can be detected, if possible, with the instruments supplied with the machine.

Figure 4:
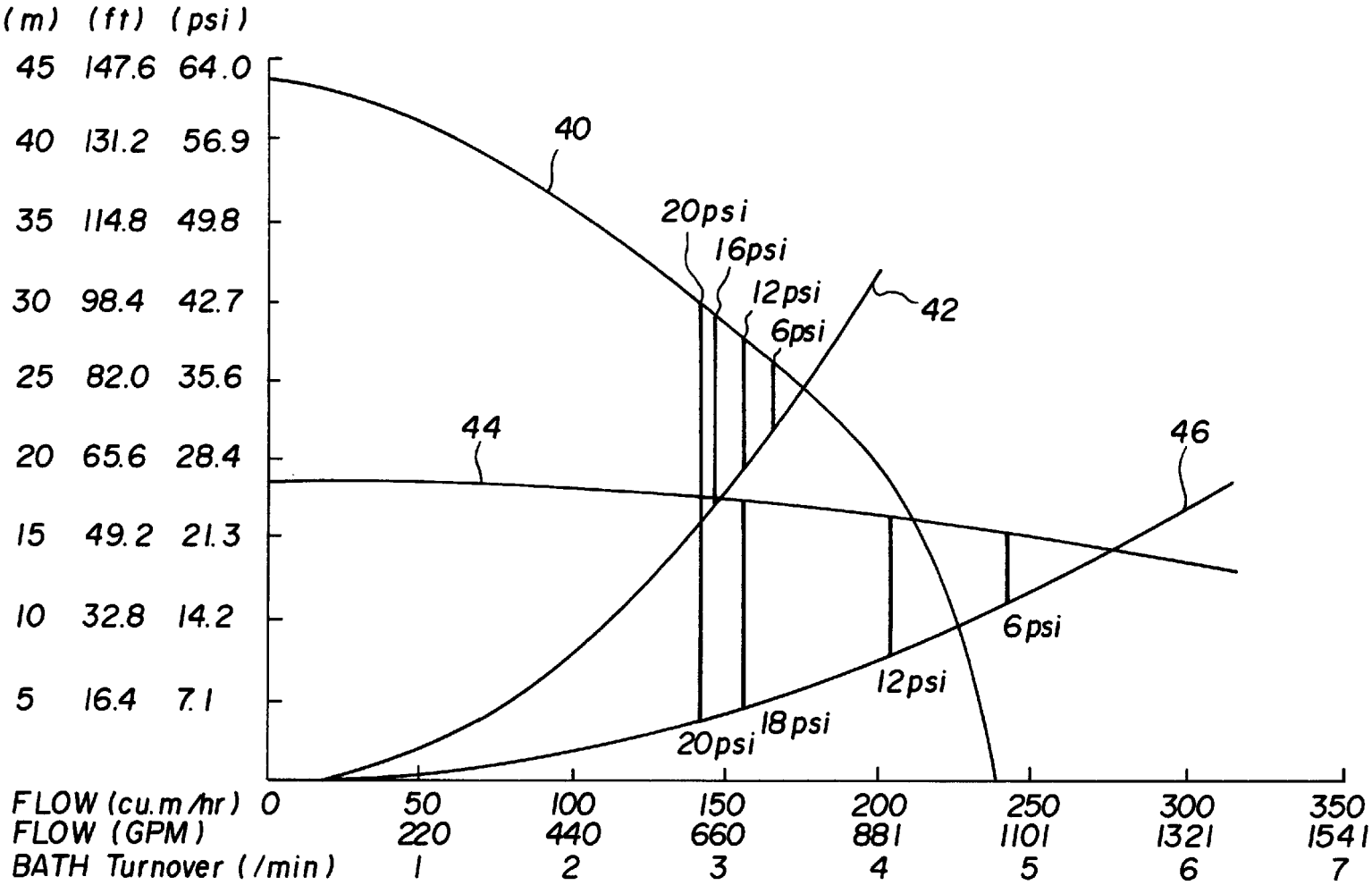
FIG. 4 is a graph depicting a performance of a conventional pump/circulating system combination in comparison with a performance of a pump/circulating system combination according to the present invention.

FIG. 4 shows a comparison of the performance between two pump/circulating system configurations. Curves 40 and 42 respectively relate to a conventional 25 HP centrifugal pump and a conventional dyeliquor system in which it is used. The curve 40 is a pressure to flow curve for the conventional centrifugal pump. The curve 42 is a system resistance curve for a conventional dyeliquor circulating system having a 60+42=102 psi vessel, used in conjunction with the conventional centrifugal pump. The curve 42 shows the resistance pressure in the system as flow increases. Curves 44 and 46 respectively relate to a pump and a circulating system used in conjunction with the pump, according to the present invention. The curve 44 is a pressure to flow curve for the pump according to the present invention, which may also be characteristic of a 25 HP pump according to UK Patent GB 2266750. The curve 46 is a system resistance curve of a dyeliquor circulating system according to the present invention, which may also be characteristic of a dyeliquor circulating system having a 26+42=68 psi vessel according to UK Patent GB 2281080. The curve 46 shows the resistance pressure in the system as flow increases.

As can be appreciated from FIG. 4, the resistance to flow of a conventional system robs the user of the most useful part of the pump performance. The vertical lines between each pair of curves, labeled with different pressure values, depict the various pressures provided by the pump that are available for driving the liquor through the load in the system at the different corresponding flowrates. The conventional pump and conventional system combination can only provide an extremely narrow operating range of flowrates, as represented by the early intersection of the curves 40 and 42.

In contrast, curves 44 and 46 intersect at a much later point on the graph, corresponding to a much higher flowrate. In other words, the pump and system combination of the present invention, corresponding to curves 44 and 46, is able to provide effective operating pressures for work on the load across a wider range of flowrates. For example, approximately 12 psi of pressure is still available for work on the load at a flowrate of approximately 200 cu.m/hr. Approximately 6 psi of pressure is also still available for work on the load at a flowrate near 250 cu.m/hr. This cannot be done by the conventional pump and system. The curves 44 and 46 show how a well designed system according to the present invention can provide an improved performance while bringing down all the pressures in the system and eliminating the need for a high pressure volute type pump.

Figure 5:
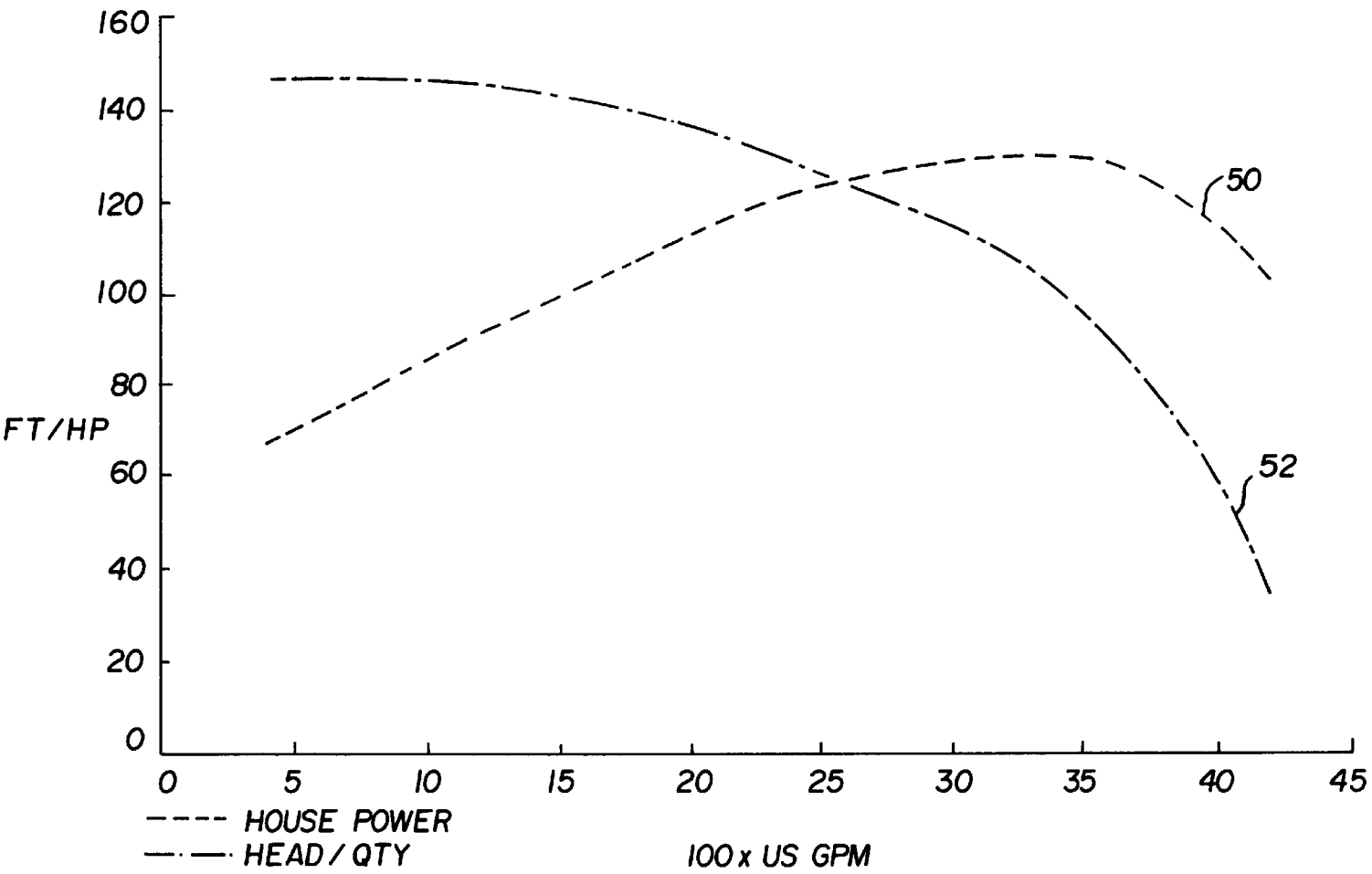
FIG. 5 is a graph plotting a power curve and a pressure curve for an unsuitable pump.

FIG. 5 is a graph also showing the characteristics of an unsuitable conventional pump. A current curve 50 (with values in horsepower) is characteristic of the unsuitable pump. A curve 52 is the pressure curve corresponding to the unsuitable pump of curve 50. As can be seen in the curve 50, the same horsepower is consumed at two different flowrates (for example, 120 horsepower at both 2220 gpm and 3850 gpm). A pump with this characteristic can not be used for control purposes above about 1600 gpm.

Not only does the present invention overcome the deficiencies in conventional systems, but also, the present invention's monitoring of the motor current to control flowrate was heretofore not done in the conventional art and was considered to be an unacceptable practice for controlling the rate of dyebath turnover. As described in detail above, the present invention allows accurate control of the rate of bath turnover by measuring and monitoring the current consumed by the electric motor 5. The preferred embodiment of the present invention also provides a linear proportionally increasing current to flowrate relationship in a close coupled system wherein all the dyeliquor passing through the pump also passes through the load. The preferred embodiment also has a low system resistance such that variations in the resistance of the load itself can produce corresponding measurable variations in the motor current.

Numerous modifications and adaptations of the present invention will be apparent to those skilled in the art. Thus, the following claims and their equivalents are intended to cover all such modifications and adaptations which fall within the true spirit and scope of the present invention.

What is claimed is:

1. An apparatus treating a load with dyeliquor, said apparatus comprising:

a pump pumping the dyeliquor;

an electric motor driving said pump;

a motor current measurement device connected to said electric motor to measure current consumed by said electric motor while driving said pump;

a dyeliquor circulating system, connected to said pump, holding the load and directing all the dyeliquor pumped by said pump to flow through the load; and a throttle valve adjusted to create a flowrate of the dyeliquor through said dyeliquor circulating system based on the current measured by said motor current measurement device, wherein the flowrate of the dyeliquor increases linearly in proportion with increases in the current consumed by said electric motor while driving said pump.

2. An apparatus according to claim 1 wherein said dyeliquor circulating system has a system resistance to dyeliquor flow which allows variations in a load resistance of the load to dyeliquor flow to produce corresponding variations in the current of said electric motor measurable by said motor current measurement device.

3. An apparatus according to claim 2 wherein an angular displacement of said throttle/reverse valve is continuously adjusted in response to the current measured by said motor current measurement device to control the dyebath turnover flowrate.

4. An apparatus according to claim 1, wherein said throttle valve is also a reverse valve by which flow is throttled rather than bypassed as said throttle/reverse valve is closed to reverse a flow direction of the dyeliquor, and wherein the flowrate is a dyebath turnover flowrate.

5. An apparatus according to claim 1 wherein said pump includes a pump casing with a collector ring having minimum resistance to flow and ample volume to collect an unmodified flow of dyeliquor directly from a pump impeller.

6. An apparatus treating a load with dyeliquor, said apparatus comprising:

a pump pumping the dyeliquor;

an electric motor driving said pump;

a motor current measurement device connected to said electric motor to measure current consumed by said electric motor while driving said pump;

a dyeliquor circulating system, connected to said pump, holding the load and directing all the dyeliquor pumped by said pump to flow through the load;

a throttle valve adjusting a flowrate of the dyeliquor through said dyeliquor circulating system; and a flow rate controller controlling adjustments to said throttle valve to control the flowrate of the dyeliquor based on the current measured by said motor current measurement device, wherein the flowrate of the dyeliquor increases linearly in proportion with increases in the current consumed by said electric motor while driving said pump.

7. An apparatus according to claim 6 wherein said dyeliquor circulating system has a system resistance to dyeliquor flow which allows variations in a load resistance of the load to dyeliquor flow to produce corresponding variations in the current of said electric motor measurable by said motor current measurement device.

8. An apparatus according to claim 6, wherein said throttle valve is also a reverse valve by which flow is throttled rather than bypassed as said throttle/reverse valve is closed to reverse a flow direction of the dyeliquor, and wherein said flowrate controller controls a dyebath turnover flowrate.

9. An apparatus according to claim 8 wherein said flowrate controller continuously adjusts an angular displacement of said throttle/reverse valve in response to the current measured by said motor current measurement device.

10. An apparatus according to claim 6 wherein said pump includes a pump casing with a collector ring having minimum resistance to flow and ample volume to collect an unmodified flow of dyeliquor directly from a pump impeller.

11. An apparatus treating a load with dyeliquor, said apparatus comprising:

a pump pumping the dyeliquor;

an electric motor driving said pump;

a motor current measurement device connected to said electric motor to measure current consumed by said electric motor while driving said pump;

a dyeliquor circulating system, connected to said pump, holding the load and directing all the dyeliquor pumped by said pump to flow through the load; and a throttle valve adjusted to create a flowrate of the dyeliquor through said dyeliquor circulating system based on the current measured by said motor current measurement device, wherein the flowrate of the dyeliquor increases with increases in the current consumed by said electric motor while driving said pump in an operating range.

12. An apparatus according to claim 11 wherein said dyeliquor circulating system has a system resistance to dyeliquor flow which allows variations in a load resistance of the load to dyeliquor flow to produce corresponding variations in the current of said electric motor measurable by said motor current measurement device.

13. An apparatus according to claim 12 wherein an angular displacement of said throttle/reverse valve is continuously adjusted in response to the current measured by said motor current measurement device to control the dyebath turnover flowrate.

14. An apparatus according to claim 11, wherein said throttle valve is also a reverse valve by which flow is throttled rather than bypassed as said throttle/reverse valve is closed to reverse a flow direction of the dyeliquor, and wherein the flowrate is a dyebath turnover flowrate.

15. An apparatus according to claim 11 wherein said pump includes a pump casing with a collector ring having minimum resistance to flow and ample volume to collect an unmodified flow of dyeliquor directly from a pump impeller.

16. A method for treating a load with dyeliquor, said method comprising the steps of:

pumping the dyeliquor;

driving said step of pumping with an electric motor;

measuring current consumed by the electric motor during said step of driving;

directing all the dyeliquor pumped by said step of pumping to flow through the load; and adjusting a flowrate of the dyeliquor based on the current measured by said step of measuring, wherein the flowrate of the dyeliquor increases linearly in proportion with increases in the current consumed by the electric motor during said step of driving.

17. A method according to claim 16, further comprising the step of providing a system resistance to dyeliquor flow during said step of directing which allows variations in a load resistance of the load to dyeliquor flow to produce corresponding variations in the current of the electric motor measurable by said step of measuring.

18. A method according to claim 16, wherein said step of adjusting adjusts a dyebath turnover flowrate based on the current measured by said step of measuring.

19. A method for treating a load with dyeliquor, said method comprising the steps of:

pumping the dyeliquor;

driving said step of pumping with an electric motor;

measuring current consumed by the electric motor during said step of driving;

directing all the dyeliquor pumped by said step of pumping to flow through the load; and adjusting a flowrate of the dyeliquor based on the current measured by said step of measuring, wherein the flowrate of the dyeliquor increases with increases in the current consumed by the electric motor during said step of driving in an operating range.

20. A method according to claim 19, further comprising the step of providing a system resistance to dyeliquor flow during said step of directing which allows variations in a load resistance of the load to dyeliquor flow to produce corresponding variations in the current of the electric motor measurable by said step of measuring.

21. A method according to claim 19, wherein said step of adjusting adjusts a dyebath turnover flowrate based on the current measured by said step of measuring.

* * * * *

UNITED STATES PATENT AND TRADEMARK OFFICE

CERTIFICATE OF CORRECTION

PATENT NO.: 6,083,284
DATED : July 4, 2000
INVENTOR(S): CLIFFORD et al.

It is certified that errors appear in the above-identified patent and that said Letters Patent is hereby corrected as shown below:

On line 60 of column 4 change, "... pump 1 is ... " to be – ....pump 3 is ....--.

On line 61 of column 4 change "... pump 1 exits... " to be –... pump 3 exits ...--.

On line 58 of column 5 change "motor 3," to be –motor 5,--.

In the Drawings:

Change "16 psi" to be --18 psi--.

Signed and Sealed this

Eighth Day of May, 2001

*Attest:*

NICHOLAS P. GODICI

*Attesting Officer*

*Acting Director of the United States Patent and Trademark Office*